US005156275A

United States Patent [19]

Murray, Sr.

[11] Patent Number: 5,156,275

[45] Date of Patent: Oct. 20, 1992

[54] COSMETIC BOTTLE COMPACT

[76] Inventor: Ralph Murray, Sr., 19920 Conley, Detroit, Mich. 48234

[21] Appl. No.: 696,593

[22] Filed: May 7, 1991

[51] Int. Cl.[5] ..... B65D 69/00

[52] U.S. Cl. ..... 206/581; 206/38; 206/38.1; 206/37

[58] Field of Search ..... 206/37.4, 38, 38.1, 206/542, 581, 823, 37; 220/23.8, 23.86, 507, 523, 524, 526, 553, 555

[56] References Cited

U.S. PATENT DOCUMENTS

| | | | |
|---|---|---|---|
| 2,630,362 | 3/1953 | Bass | 206/38 |
| 2,727,547 | 12/1955 | Moon | 206/38 |
| 3,052,368 | 9/1962 | Atkins et al. | 220/555 |
| 3,258,017 | 6/1966 | Albert | 206/581 |
| 3,286,751 | 11/1966 | Dishart | 206/38.1 |
| 4,201,290 | 5/1980 | Madden | 206/38 |
| 4,526,273 | 7/1985 | Tsuji et al. | 206/815 |
| 4,729,489 | 3/1988 | Papaianni | 220/23.8 |
| 4,741,434 | 5/1988 | Liebman | 206/38.1 |
| 4,844,309 | 7/1989 | Aubin et al. | 206/541 |
| 4,848,586 | 7/1989 | Jasik | 206/581 |
| 5,060,794 | 10/1991 | Linn et al. | 206/38.1 |

FOREIGN PATENT DOCUMENTS

| | | | |
|---|---|---|---|
| 3744438 | 7/1989 | Fed. Rep. of Germany | 220/507 |
| 2488108 | 2/1982 | France | 206/38 |
| 11581 | of 1912 | United Kingdom | 206/38 |
| 657516 | 9/1951 | United Kingdom | 206/581 |

*Primary Examiner*—David T. Fidei

[57] ABSTRACT

A cosmetic bottle compact 10 consisting of a set 12 of generally rectangularly configured compartments 14, 16, 18 disposed to form a case body 20 having an integrated exterior surface 22, each of the compartments 14, 16, 18 having an opening 24, 26, 28 disposed in a common surface of the case body 20 and being closed along any other exterior surface thereof, at least a first compartment 14 constructed and arranged in the case body 20 for its inside configuration to accomodate a cosmetic bottle 30 having its outside configuration conforming to the inside configuration of the first compartment 14, at least a second compartment 16 constructed and arranged in the case 20 for its inside configuration to accomodate stacked money or change (not shown) having its outside configuration conforming to the inside configuration of the second compartment 16, at least a third compartment 18 constructed and arranged in the case body 20 for its inside configuration to accomodate a lipstick (not shown) having its outside configuration conforming to the inside configuration of the third compartment 18, a mirror 32 of plastic construction disposed on a generally flat portion of the exterior surface 22 of the case body 20, a key ring 40 affixed to the case body 20, and an alarm or defensive component 50 affixed onto another portion of the exterior surface of the case body 20.

5 Claims, 3 Drawing Sheets

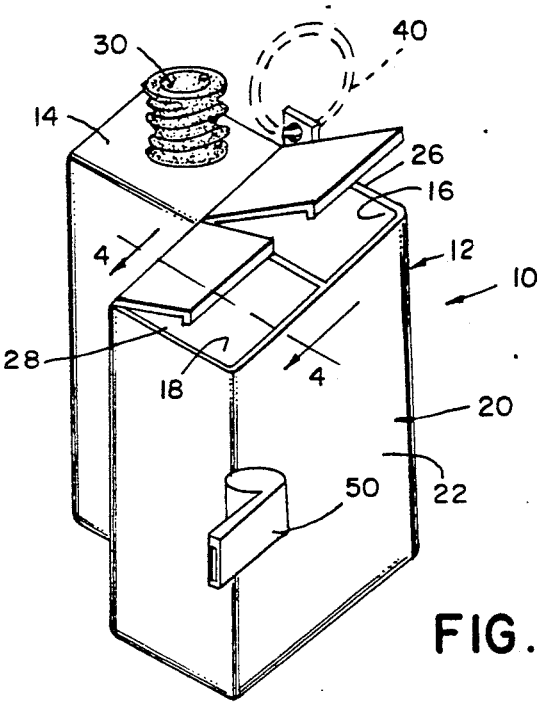
FIG. 1
FIG. 4
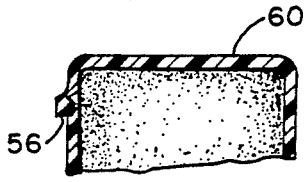
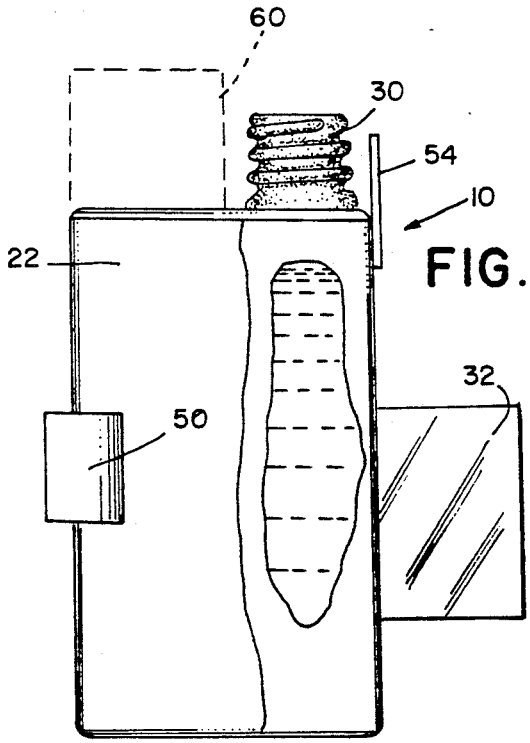
FIG. 2
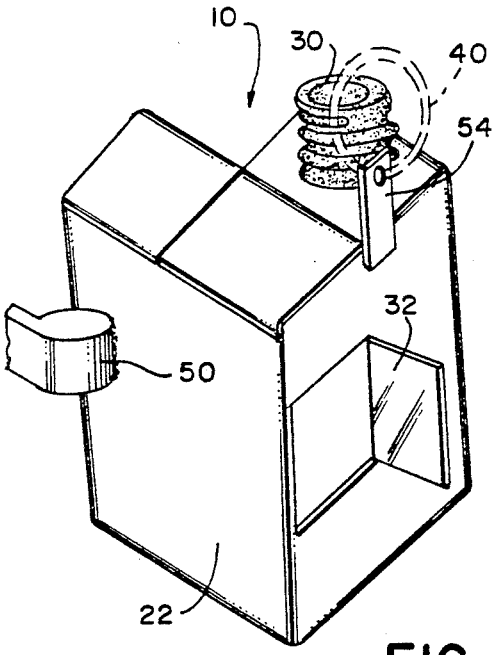
FIG. 3

COSMETIC BOTTLE COMPACT

FIELD OF THE INVENTION

The invention relates to a new and improved cosmetic bottle compact arrangement, and more particularly, the invention is directed to a cosmetic bottle compact consisting of a set of generally rectangularly configured compartments disposed to form a case body having an integrated exterior surface, each of the compartments having an opening disposed in a common surface of the case body and being closed along any other exterior surface thereof, at least a first compartment constructed and arranged in the case body for its inside configuration to accomodate a cosmetic bottle having its outside configuration conforming to the inside configuration of the first compartment, at least a second compartment constructed and arranged in the case body for its inside configuration to accomodate stacked money or change having its outside configuration conforming to the inside configuration of the second compartment, at least a third compartment constructed and arranged in the case body for its inside configuration to accomodate a lipstick having its outside configuration conforming to the inside configuration of the third compartment, a mirror of plastic construction disposed on a generally flat surface of the case body, a key ring affixed to the case body, and an alarm or defensive component affixed onto a surface of the case body.

The invention relates further to a device providing for a cosmetic bottle compact that is portable, for carrying bottles and lipstick and money or change along with other selected items; and for uses away from the home, the compact arrangement of the invention has five or six or more compartments, including a compartment for a small cosmetic bottle that holds cosmetic liquid such as lotion, perfume and the like and when liquid is exhausted, the cosmetic bottle may be refilled over and over again; including a money or change compartment for use when change is needed for toll-gates, toll telephone calls, coin machines, etc.; including a compartment for lipstick; a mirror of glass or plastic affixed to an outer surface of the device for use during application of the cosmetic or lipstick; including a key ring holder for receiving house keys, car keys, locker keys and the like; and including an alarm component such as a whistle or gas alarm cylinder, common and well-known in the art; as is more particularly described herein. The whistle or alarm component is used to obtain attention when waving down a taxi, bus or airport limousine, or also when under conditions of apparent circumstances of immediate fear or harm being present, either of the user or of someone in need of medical care.

BACKGROUND OF THE INVENTION

Description of the Prior Art

Various prior art dispensing combs and combs with distribution devices, and the like, as well as apparatus and method of their construction in general, are found to be known, and exemplary of the U.S. prior art are the following:

Tsuji 4,526,273
Aguirrectal 4,739,990
Aubin 4,844,309

Tsuji is a disclosure for a portable cosmetic case containing containers for lipsticks, a compacted powder case, and a painting brush inserted in the case.

Aguirre et al show a whistle and that includes a temporarily disabling liquid such as MACE which when sprayed in the face of a person causes tears, dizziness, immobilization and sometimes nausea. The device can be used to propel MACE, a stable dye, or a penetrating odor. Also disclosed is a loop for attachment to a ring member as shown therein.

Aubin shows a carry all device having a plurality of compartments, some hinged, for enclosing various forms of equipment, and also provided wi:h additional structure supporting exterior devices for portage.

These patents or known prior uses teach and disclose various types of cosmetic compacts and portable container bodies of sorts and of various manufactures and the like as well as methods of their construction, but none of them whether taken singly or in combination disclose the specific details of the cosmetic bottle compact combination of the invention in such a way as to bear upon the claims of the present invention.

SUMMARY OF THE INVENTION

An object, advantage and feature of the invention is to provide a novel cosmetic bottle compact having versatile uses and construction to provide a fully utilitarian article having uses for any of various circumstances that one may find themselves in at this stage of civilization.

Another object of the invention is directed further to a device providing for attending to any of several uses and providing many facilities in a wholly unitary device.

Also an object of the invention is to provide a simple cosmetic bottle compact consisting of a set of generally rectangularly configured compartments disposed to form a case body having an integrated exterior surface, each of the compartments having an opening disposed in a common surface of the case body and being closed along any other exterior surface thereof, at least a first compartment constructed and arranged in the case body for its inside configuration to accomodate a cosmetic bottle having its outside configuration conforming to the inside configutation of the first compartment, at least a second compartment constructed and arranged in the case body for its inside configuration to accomodate stacked money or change having its outside configuration conforming to the inside configuration of the second compartment at least a third compartment constructed and arranged in the case body for its inside configuration to accomodate a lipstick having its outside configuration conforming to the inside configuration of the third compartment, a mirror of plastic construction disposed on a generally flat surface of the case body, a key ring affixed to the case body, and an alarm or defensive component affixed onto a surface of the case body.

These together with other objects and advantages will be readily appreciated as the same becomes better undertood and which will become subsequently apparent to reside in the details of the process and operation thereof as more fully hereinafter is described and claimed, reference being had to the following detailed description and the accompanying drawings forming a part hereof, wherein like numerals refer to like parts throughout.

DESCRIPTION OF THE SEVERAL VIEWS OF THE DRAWINGS

FIG. 1 is a perspective view of the cosmetic bottle compact and illustrating a typical construction according to a preferred embodiment and best mode of the present invention.

FIG. 2 is a rotated perspective view of FIG. 1.

FIG. 3 is an elevational view of the cosmetic bottle compact, shown partially in cut away for showing the contents of the bottle component.

FIG. 4 is a sectional view taken along line 4—4 of FIG. 1 showing a cap of the cosmetic bottle compact in a snapped closed position.

DESCRIPTION OF A PREFERRED EMBODIMENT OF THE INVENTION

Figure 5:
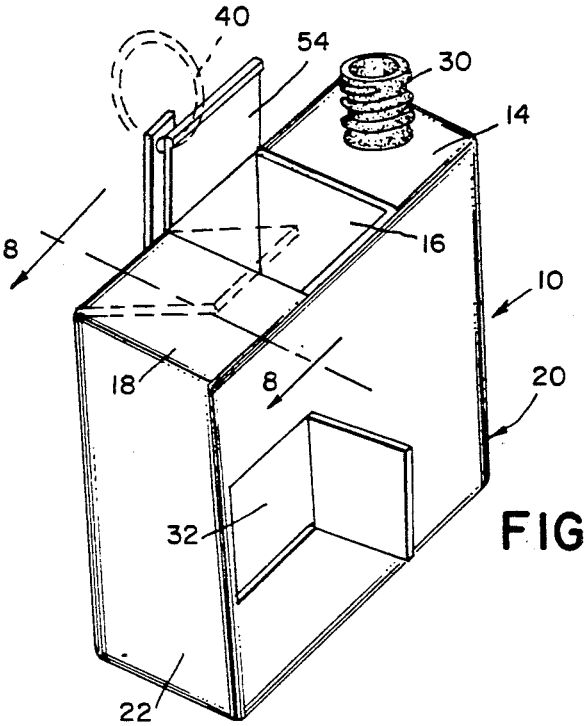
FIG. 5 is a perspective view of another cosmetic bottle compact and illustrating a typical construction according to another preferred embodiment and best mode of the present invention.

Referring now to the drawings there is shown in FIGS. 1-8 a cosmetic bottle compact 10 consisting of a set 12 of generally rectangularly configured compartments 14, 16, 18 generally disposed to form a case body 20 having an integrated exterior surface 22, and each of the compartments 14, 16, 18 having an opening 24, 26, 28 disposed in a common surface of the case body 20 and being closed along any other portion of the exterior surface 22 thereof.

At least a first compartment 14 constructed and arranged in the case body 20 for its inside configuration to accomodate a cosmetic bottle 30, which may be removable but as well may be made integrally with the material of the set 12, having its outside configuration conforming to the inside configuration of the first compartment 14, at least a second compartment 16 constructed and arranged in the case body 20 for its inside configuration to accomodate stacked money or change (not shown) having its outside configuration conforming to the inside configuration of the second compartment 16, at least a third compartment 18 constructed and arranged in the case body 20 for its inside configuration to accomodate a lipstick (not shown) having its outside configuration conforming to the inside configuration of the third compartment 18.

A mirror 32 of plastic construction is disposed, by glue or plastic adhesive or cohesive material, to adhere or cohere onto a generally flat portion of the exterior surface 22 of the case body 20, a key ring 40 affixed on to a tab 54 to the case body 20, and an alarm or defensive component 50, such as a whistle, or the like, affixed similarly as the mirror 32 or the key ring 40 onto another portion of the exterior surface of the case body 20. The mirror 32, key ring 40 and component 50 are spatially equally disposed about in zones or sectors of the peripheral surface 22.

Any form of defensive component may be used and incorporated into the cosmetic bottle compact of the invention, one form of defensive component being MACE TM and DEFIANCE TM which are trademarks of a liquid or spray product used and defined by Webster's New Collegiate Dictionary (1977) as a temporarily disabling liquid that when sprayed in the face of a person causes tears, dizziness, immobilization, and sometimes nausea. Of course one form of the invention provides merely for the use of a whistle alarm.

The arrangement of the compartments 14, 16, 18 may be in a general zig-zag form as shown in FIGS. 1-4, or may be in general alignment as is displayed in FIGS. 5-8. Also the case body 20 may be constructed of flexible plastic, or a rigid plastic, and that may be colored and durable.

Figure 8:
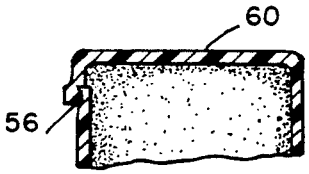
FIG. 8 is a sectional view taken along line 8—8 of FIG. 5 showing a cap of the cosmetic bottle compact in a snapped closed position.
Figure 7:
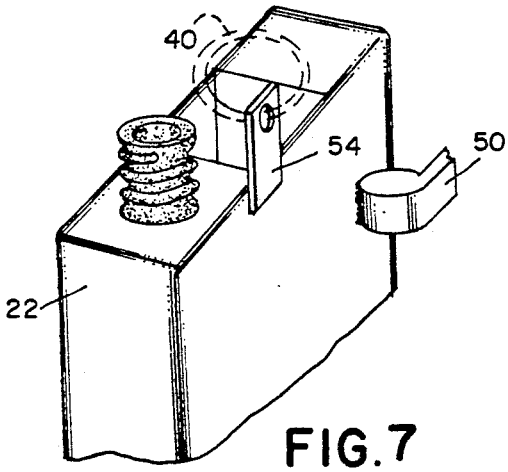
FIG. 7 is an elevational view of the cosmetic bottle compact, shown partially in cut away for showing the contents of the bottle component.
Figure 6:
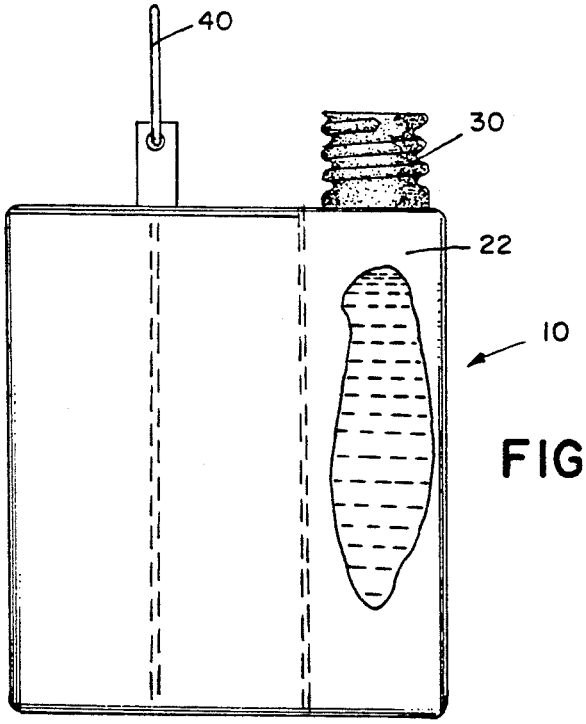
FIG. 6 is a rotated perspective view of FIG. 5.

FIGS. 4 and 8 show a snap-fitting closure 56 for the plastic lid or closure 60 and is constructed of molded or plastic material.

Figure 9:
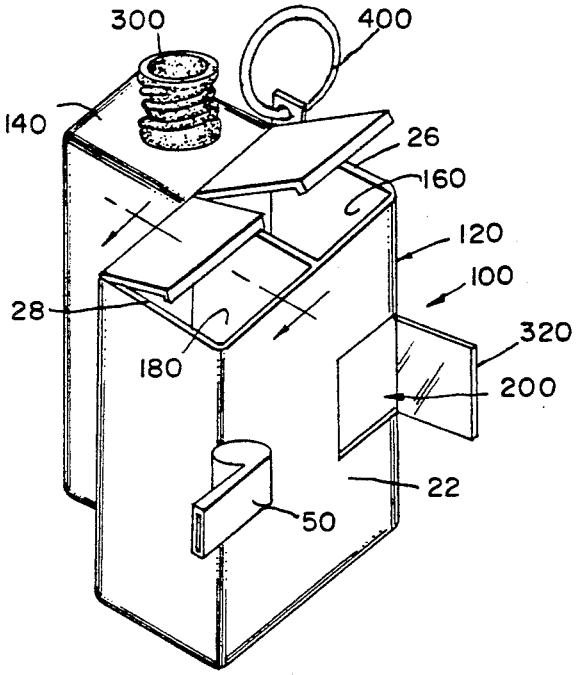
FIG. 9 is a perspective view showing a compartment for receiving a cosmetic bottle.
Figure 10:
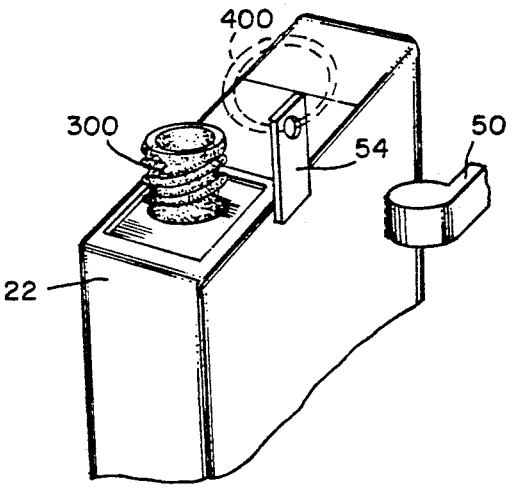
FIG. 10 is a perspective view also showing a compartment for receiving a cosmetic bottle.

FIGS. 9 and 10 show a cosmetic bottle 100 having a compartment for receiving a cosmetic bottle and consisting of a set 120 of compartments 140, 160, 180 to form a case body 200, and including a mirror 320. The bottle 300 may be replaceable in the compartment 140. The ring 400 may similarly receive a whistle as shown by the loop in Aguirre et al.

The apparatus of the cosmetic bottle compact 10 of the invention may be so constructed and arranged in its component parts that it may be assembled as a kit or in kit form.

The foregoing is considered as illustrative only of the principles of this invention in its simplicity and effectiveness as a cosmetic bottle compact and which eliminates the complexity, weight and inefficiency of devices currently used for these purposes. Further, since numerous modifications and changes and advantages will readily occur and will be apparent to those skilled in the art in view of the above teachings, obviously many modifications and variations of the present invention are possible in light of the above teachings as may occur to those skilled in the art. It is therefore to be understood that within the scope of the appended claims the invention may be practiced otherwise than as specifically described, and it is not desired to limit the invention to the exact construction and operation shown and described; accordingly, all suitable modifications and equivalents may be resorted to falling within the scope of the invention.

What is claimed and desired to be secured by Letters patent is:

1. Cosmetic bottle compact comprising a set of a plurality of generally rectangularly configured compartments defining in at least two dimensions a planar surface being common to at least one surface of each of the compartments and surfaces not within the at least two dimensions defining a case body having an integrated exterior surface, each of the compartments of the set having an opening disposed in the planar surface of the case body and not having an opening in the exterior surface thereof, at least a first compartment constructed and arranged in the case body having an inside configuration to accomodate in the opening thereof reception of a cosmetic bottle having an outside configuration of the cosmetic bottle being adapted to conform to the inside configuration of the first compartment, at least a second compartment constructed and arranged in the case body having an inside configuration to accomodate in the opening thereof reception of stacked money or change having an outside configuration of the stacked money is adapted to conform to the inside configuration of the second compartment, at least a third compartment constructed and arranged in the case body having an inside configuration to accomodate in the opening thereof reception of a lipstick having an outside configuration of the lipstick is adapted to conform to the inside configuration of the third compartment, mirror means of plastic construction disposed on a generally flat portion of the exterior surface of the case body, means affixing a key ring to the case body, and means affixing a whistle as an alarm means onto a portion of a surface of the case body, and an arrangement of the at least first compartment, the at least second compartment and the at least third compartment being linearly aligned along a diagonal direction.

2. Cosmetic bottle compact comprising a set of a plurality of generally rectangularly configured compartments defining in at least two dimensions a planar surface being common to at least one surface of each of the compartments and surfaces not within the at least two dimensions defining a case body having an integrated exterior surface, each of the compartments of the set having an opening disposed in the planar surface of the case body and not having an opening in the exterior surface thereof, at least a first compartment constructed and arranged in the case body having an inside configuration to accomodate in the opening thereof reception of a cosmetic bottle having an outside configuration of the cosmetic bottle being adapted to conform to the inside configuration of the first compartment, at least a second compartment constructed and arranged in the case body having an inside configuration to accomodate in the opening thereof reception of stacked money or change having an outside configuration of the stacked money is adapted to conform to the inside configuration of the second compartment, at least a third compartment constructed and arranged in the case body having an inside configuration to accomodate in the opening thereof reception of a lipstick having an outside configuration of the lipstick is adapted to conform to the inside configuration of the third compartment, mirror means of plastic construction disposed on a generally flat portion of the exterior surface of the case body, means affixing a key ring to the case body, and means affixing a whistle as an alarm means onto a portion of a surface of the case body, and an arrangement of the at least first compartment, the at least second compartment and the at least third compartment each having at least two dimensions of the exterior surface thereof disposed within a planar surface being common to at least one exterior surface of each of the compartments.

3. The apparatus of claim 1 or 2 wherein the alarm means is a unit including a temporarily disabling liquid that when sprayed in the face of a person caused tears, dizziness, immobilization and sometimes nausea.

4. The apparatus of claim 1 or 2 wherein the case body is made of plastic.

5. The apparatus of claim 1 or 2 wherein the case body is made of molded material.

* * * * *